United States Patent [19]

Lutz

[11] Patent Number: 4,992,079

[45] Date of Patent: Feb. 12, 1991

[54] PROCESS FOR PREPARING A NONPHOSPHATE LAUNDRY DETERGENT

[75] Inventor: Charles W. Lutz, Princeton, N.J.

[73] Assignee: FMC Corporation, Philadelphia, Pa.

[21] Appl. No.: 290,491

[22] Filed: Dec. 27, 1988

Related U.S. Application Data

[63] Continuation-in-part of Ser. No. 929,128, Nov. 7, 1986, abandoned, which is a continuation-in-part of Ser. No. 808,318, Dec. 12, 1985, abandoned.

[51] Int. Cl.[5] ..... C11D 3/10

[52] U.S. Cl. ..... 23/313 R; 23/313 FB; 252/174; 252/174.13; 252/174.14

[58] Field of Search ..... 23/313 R, 313 AS, 313 FB; 252/94, 174, 174.14, 174.13; 264/117; 423/186, 426

[56] References Cited

U.S. PATENT DOCUMENTS

| | | | |
|---|---|---|---|
| 3,235,329 | 2/1966 | Gancy | 423/425 |
| 3,695,831 | 10/1972 | Goldstein | 423/425 |
| 3,920,586 | 11/1975 | Bonaparte et al. | 252/174.13 |
| 3,933,670 | 1/1976 | Brill et al. | 23/313 R |
| 3,971,726 | 7/1976 | Smith, Jr. et al. | 252/174.14 |
| 4,070,765 | 1/1978 | Hovmand et al. | 34/10 |
| 4,115,525 | 9/1978 | Gancy et al. | 423/425 |
| 4,141,841 | 2/1979 | McDanald | 252/8.8 |
| 4,171,278 | 10/1979 | Andree et al. | 252/102 |
| 4,184,970 | 1/1980 | Draper, Jr. | 252/8.8 |
| 4,215,007 | 7/1980 | Krings et al. | 23/313 S |
| 4,219,436 | 8/1980 | Gromer et al. | 252/135 |
| 4,265,772 | 5/1981 | Jones | 252/8.6 |
| 4,272,386 | 6/1981 | Draper, Jr. et al. | 252/8.6 |
| 4,273,590 | 6/1981 | Cronewitz et al. | 127/44 |
| 4,283,302 | 8/1981 | Foret et al. | 252/102 |
| 4,292,035 | 9/1981 | Battrell | 8/137 |
| 4,321,157 | 3/1982 | Harris et al. | 252/174.25 |
| 4,328,114 | 5/1982 | Johnson et al. | 252/135 |
| 4,347,152 | 8/1982 | Wixon | 23/313 R |
| 4,395,291 | 7/1983 | Limare et al. | 106/297 |
| 4,427,417 | 1/1984 | Porasik | 23/313 R |
| 4,430,243 | 2/1984 | Bragg | 252/91 |
| 4,434,068 | 2/1984 | Delwel et al. | 252/135 |
| 4,436,644 | 3/1984 | Johnson et al. | 252/174.13 |
| 4,444,674 | 4/1984 | Gray | 252/95 |
| 4,447,349 | 5/1984 | Tai | 252/174.13 |
| 4,451,387 | 5/1984 | Tai | 252/174.15 |

OTHER PUBLICATIONS

Kirk et al., "Encyclopedia of Chemical Technology", 3rd Ed., vol. 1, pp. 866–877, 1978.

Kirk et al., "Encyclopedia of Chemical Technology", 3rd Ed., vol. 22, pp. 355–358, 420–422.

*Primary Examiner*—Gary P. Straub

*Assistant Examiner*—R. Bruce Breneman

*Attorney, Agent, or Firm*—Robert D. Jackson; Frank Ianno

[57] ABSTRACT

Low bulk density, soda ash-based, nonphosphate laundry detergents are prepared by (a) loading nonaqueous liquid surfactant onto substantially anhydrous, hydratable soda ash particles, (b) turbulently dispersing the surfactant-loaded particles into an inert gaseous medium while wetting the dispersed particles with an atomized stream of dilute aqueous sodium silicate or with separate atomized streams of water and concentrated aqueous sodium silicate, and (c) recovering the resultant particulate detergent. Preferably, natural soda ash is used in the process, and both nonionic and anionic surfactants are loaded onto the soda ash, in that order.

16 Claims, No Drawings

PROCESS FOR PREPARING A NONPHOSPHATE LAUNDRY DETERGENT

This application is a continuation-in-part of application Ser. No. 929,128, filed Nov. 7, 1986, now abandoned which is a continuation-in-part of application Ser. No. 808,318, filed Dec. 12, 1985 and abandoned as of the filing of this application.

This invention relates to the preparation of low bulk density, soda ash-based, nonphosphate laundry detergents.

Nonphosphate detergents, commonly containing hydrated soda ash ($Na_2CO_3$) in place of phosphate, are more difficult to formulate to make them competitive with phosphate-containing detergents. The key properties to be considered for development of effective laundry detergents are bulk density, particle size distribution, particle shape, flow properties, dustiness, hygroscopicity, porosity, absorptivity and rate of hydration. Of the foregoing properties, those which are the most difficult to improve are bulk density and absorptivity, the former being a property of the finished laundry detergent and the latter being a property of the soda ash component. Absorptivity defines the ease with which the soda ash absorbs surfactant during formulation of the laundry detergents and also affects the ease with which the formulated laundry detergent flows and resists caking.

Accordingly, attention has focused on methods of admixing liquid surfactants with detergent builders such as soda ash, including degree and rate of hydration of the soda ash, and a resultant dry detergent exhibiting the required particle size, flow, resistance to caking and other properties. However, the various mixing processes have limitations. For example, dry blending cannot be used effectively with natural source soda ash.

U. S. Pat. No. 4,427,417 to Porasik reviews various methods and apparatus for preparing granular laundry detergents and describes an agglomeration process wherein a particulate, hydratable detergent salt such as soda ash is turbulently dispersed in an inert gaseous medium such as atmospheric air, nitrogen or carbon dioxide, wetted with an atomized stream of water or with an aqueous alkali metal silicate to substantially hydrate the detergent salt, followed by aging of the agglomerates in contact with a hydrating agent and by a second turbulent dispersion in an inert gaseous medium while concurrently mixing therewith one or more surfactants or other materials.

While the Porasik agglomeration process provides substantial improvements over other processes reviewed therein, the process suffers from various deficiencies when applied to admixing soda ash and surfactants, including inability to fully absorb the surfactant onto the soda ash particles with consequent loss of surfactant and increased cost of manufacture.

It has now been found that if the agglomeration process of Porasik is modified by loading nonaqueous liquid surfactant onto soda ash particles before agglomeration and hydration by the turbulent dispersion technique of the patent, substantial improvements are realized in absorptivity of surfactant by the soda ash particles and the resulting nonphosphate laundry detergent manifests low bulk density, good flow, noncaking properties, excellent porosity, and high rates of hydration and dissolving. Additional improvements in such properties are obtained by utilizing natural soda ash, preferably natural soda ash refined by the sesquicarbonate process, rather than synthetic soda ash.

In one aspect of the invention, therefore, an agglomeration process for preparing a low bulk density, soda ash-based, nonphosphate laundry detergent is provided wherein nonaqueous liquid surfactant is loaded onto soda ash particles, followed by turbulent dispersion of the surfactant-loaded particles into an inert gaseous medium while wetting the dispersed particles with an atomized stream of dilute aqueous sodium silicate or with separate atomized streams of water and concentrated aqueous sodium silicate, and recovering the resultant particulate detergent.

In another aspect of the invention, it has been found that although both natural and synthetic soda ash can be used in the agglomeration process of the invention, further improvements are achieved with natural soda ash, particularly natural soda ash refined by the sesqui process.

In a preferred aspect of the invention, both a nonionic and an anionic surfactant are loaded, in that order, onto the particulate soda ash in the first step of the process of the invention.

The foregoing and other aspects, features and benefits of the invention will be evident from the description which follows.

In the first step (a) of the process of the invention, a nonaqueous liquid surfactant is loaded onto substantially anhydrous, hydratable soda ash particles. Any method effective for uniform coating of the soda ash particles with the liquid surfactant will be suitable, including drum or rotary mixers of various kinds, blenders such as ribbon blenders, spray applicators and agglomerators. While it is possible to utilize the same apparatus as is employed in the second step of the process (described below), from the standpoint of efficiency and control it is preferred to load the nonaqueous liquid surfactant onto the soda ash particles in a separate mixing device, most preferably a ribbon blender, and then to transfer the surfactant-loaded soda ash particles to a second stage for the primary agglomeration and hydration. A variety of blenders suitable for the surfactant-loading step are commercially available and, therefore, require no further description.

In surfactant-loading step (a), the soda ash is first charged to the mixer followed by the liquid surfactant in metered amounts, preferably as a spray. From about 5% to about 20% by weight of surfactant based on weight of total laundry detergent formulation is blended with the soda ash, preferably about 10% to 15% by weight. Lower amounts will not provide a sufficiently effective laundry detergent and higher amounts tend to absorb poorly, rendering the laundry detergent sticky with a tendency to cake and increasing manufacturing costs. Mixing time may vary from about several minutes to several hours, depending upon the nature of the mixing apparatus, quantities of materials and other variables known to those skilled in the art. Ambient temperature conditions are effective.

The surfactant may entirely comprise a nonionic material. Preferably, however, a portion of nonionic surfactant is first blended with the soda ash followed by addition of an anionic surfactant. This sequence of addition has been found to improve overall absorption of surfactant into the soda ash particles, probably because the absorption of the nonionic surfactant is primarily a physical interaction and, therefore, is more actively absorbed into the pores of the soda ash. Since an anionic surfactant tends to chemically interact with the soda ash, if used in the acid form, the porosity of the soda ash would be severely reduced or destroyed if the anionic surfactant was blended into the soda ash before admixture with the nonionic surfactant. While the nonionic and anionic surfactants ma also be premixed before addition to the soda ash, it is preferred to add the surfactants sequentially in the order indicated. From about 10% to 20%, preferably 8% to 15%, by weight of nonionic surfactant based on the weight of total laundry detergent formulation will be used, followed by the addition of about 5% to 20%, preferably 10% to 15%, by weight of anionic surfactant also based on total detergent formulation weight, wherein the total amount of surfactant normally will not exceed 25% on total detergent formulation weight.

Any conditions effective for reducing the viscosity of the surfactant/soda ash mixture in order to obtain a fine distribution of surfactant and consequently more uniform distribution on the soda ash particles will be useful. For example, in some cases heat may be applied during the blending and the liquid surfactant may be atomized in order to obtain the requisite distribution.

Suitable nonionic surfactants, useful singly or in admixture of two or more, include the polyoxyethylene condensates, also known as "ethoxylates"; the alcohol ethoxylates; alkylphenol ethoxylates; carboxylic acid esters; glycerol esters; polyoxyethylene esters; anhydrosorbitol esters; ethoxylated anhydrosorbitol esters; ethoxylated natural fats, oils and waxes; glycol esters of fatty acids; carboxylic amides such as diethanolamine and monoalkanolamine condensates, and polyoxyethylene fatty acid amides; polyalkylene oxide block copolymers; and poly(oxyethylene-co-oxypropylene) polymers. Of the foregoing, the polyoxyethylenes and alcohol ethoxylates are preferred. Representative of the latter are materials sold under the trademark and designation "Neodol", for example, condensates of the formula $R(OCH_2CH_2)_nOH$ wherein n varies from about 3 to 10 and R is a straight or branched hydrocarbon chain containing from about 12 to 15 carbon atoms.

Suitable anionic surfactants may be prepared by sulfating the foregoing nonionic alcohol ethoxylate surfactants in a known manner. For example, if it is desired to use a mixture of nonionic and anionic surfactants, the nonionic may be treated with the requisite amount of sulfuric acid to convert a portion of the nonionic into the sulfated anionic form. Alternatively, the anionic surfactants may be separately prepared and blended with the soda ash or with a nonionic surfactant prior to addition to the soda ash. A wide variety of anionics, useful singly or in mixtures of two or more, are commercially available for this purpose and include carboxylates such as carboxylic acid containing fluorinated alkyl chains, polyalkoxycarboxylates, N-acyl sarcosinates, and acylated protein hydrolysates. Other anionic surfactants include alkylsulfonates, alkylbenzenesulfonates such as dodecylbenzenesulfonate, alkylarenesulfonates, lignosulfonates, naphthalenesulfonates, alpha-olefin sulfonates, petroleum sulfonates, dialkylsulfosuccinates, amidosulfonates and 2-sulfoethyl esters of fatty acids. Other anionics include sulfates such as alcohol sulfates, for example, sodium lauryl sulfate, ethoxylated-sulfated alcohols, alkylphenols which have been ethoxylated and sulfated, sulfated acids, amides and esters, and sulfated natural oils and fats. Of the foregoing, the alkylbenzenesulfonates are preferred. The foregoing and other suitable nonionic and anionic surfactants are well-known as described, for example, in Kirk-Othmer, Encyclopedia of Chemical Technology, 3d. edition, Vol. 22, page 347 et seq., incorporated herein by reference.

Both synthetic (Solvay process) and natural soda ash may be employed in the process of the present invention but natural source soda ash is preferred, particularly natural soda ash refined by the sesqui (sesquicarbonate) process. The latter material has been found to provide a lower bulk density laundry detergent when prepared in accordance with the present invention. Natural soda ash refined by the monohydrate process or by the brine process may also be employed. All of such refinement processes are well known and require no further description. The soda ash may contain some water of hydration but preferably is anhydrous. In any event, the soda ash is susceptible to further, substantial hydration.

In the second step (b) of the agglomeration process of the invention, the surfactant-loaded soda ash particles from the first step are turbulently dispersed into an inert gaseous medium while the dispersed particles are wetted with an atomized stream of either dilute aqueous sodium silicate or with separate atomized streams of water and concentrated aqueous sodium silicate. This step is a simultaneous hydration and agglomeration and, contrary to the Porasik patent, must be practiced after the surfactant addition rather than before or simultaneously with surfactant addition. Thus, it has been observed that the addition of surfactant during or after the agglomeration-hydration leads to poor absorption of the surfactant since the initial agglomeration-hydration apparently seals the pores of the soda ash so that it will no longer effectively absorb the surfactant. If the surfactant is added during the agglomeration-hydration, the tendency is to get a wet and/or tacky material rather than a granular laundry detergent product. The amount of aqueous sodium silicate to be added during the agglomeration-hydration step may range from about 5% to about 25% by weight as an aqueous concentrate containing 38 weight percent sodium silicate, based on the weight of total laundry detergent formulation, preferably about 15% to about 20% on the same basis. Other amounts of aqueous sodium silicate may, of course, be employed, depending on the silicate concentration and agglomeration conditions, including the agglomeration apparatus and its mode of operation. It is unexpected that wetting of the loaded soda ash does not result in bleeding of the nonionic surfactant.

As indicated, the water for the hydration may be atomized and applied to the dispersed particles either separate from the sodium silicate or by virtue of a dilute aqueous sodium silicate atomized stream. The concentrations of the streams and means of atomization and application to the dispersed surfactantloaded soda ash particles are fully described in the Porasik patent, the entire disclosure of which is incorporated herein by reference. A particularly suitable form of agglomerator is the Shugi Flexomix Model No. 250 or 160 blender-/agglomerator having two powder inlets and powered by a 10 h.p., 1800 rpm explosion proof motor, sold by Bepex Corporation, Minneapolis, Minn. The agglomeration step is run at about 20° C. to 70° C., preferably about 40° C. to 60° C. The higher temperatures help to reduce viscosity for better distribution but have very little effect on absorptivity.

Although hydration and agglomeration occur essentially simultaneously, a certain period of time is sometimes required after agglomeration to complete the hydration of the soda ash. This is achieved either in the agglomerator apparatus itself or by transferring the agglomerated material to a separate vessel for aging. The completion of hydration also may be achieved by conditioning, that is, applying heat to the agglomerated material while fluidizing the same in a fluid bed dryer, as described in the Porasik patent, with the result that the simultaneous drying an heating drives the hydration to completion and removes surface moisture for recovery of a dry, free flowing, nontacky and noncaking, particulate product having a bulk density in the range of 0.55–0.7 g/cc, preferably 0.6 g/cc or lower.

If desired, nonphosphate detergent additives of various types may be blended with the surfactantloaded soda ash particles either by introduction into the turbulent dispersion during the agglomeration step (b) or prior thereto. Among such detergent additives may be mentioned one or more of sodium sulfate, sodium chloride, sodium carboxymethylcellulose, optical brighteners, pigments and other coloring agents, and perfumes. A variety of other additives will also be apparent to those skilled in the art of detergent formulation.

The following examples are intended as further illustration of the invention but without limiting the scope thereof.

EXAMPLE I

Formulation

Nonphosphate laundry detergents were prepared in a variety of ways from the following basic recipe:

| | Wt. % |
|---|---|
| Soda Ash, Anhydrous | 64.0 |
| Nonionic Surfactant | 2.5 |
| Anionic Surfactant | 4.5 |
| Sodium Silicate, Liquid | 15.0 |
| Water | 11.0 |
| Miscellaneous (Optional) | 3.0 |
| | 100.0 |

The nonionic surfactant was an alcohol ethoxylate of the formula $R(OCH_2CH_2)_nOH$ where $R=C_{12-C15}$ and $n=3$ (Neodol 25-3, Shell). The anionic surfactant was the sulfated form of the alcohol ethoxylate, formed in situ from a solution of 74% Neodol 25-3 and 26% sulfuric acid (Neodol 25-3S, Shell). The sodium silicate was a liquid material containing 38% by weight sodium silicate ("N silicate", PQ Corporation). Typical miscellaneous components and approximate amounts are carboxymethylcellulose (0.7%), polyvinyl alcohol (0.7%), sodium sulfate (2.1%), sodium bicarbonate (0.44%), an optical brightener (0.18%), and perfume (0.1%).

Blending Process

With the exceptions in process conditions indicated in Table I, the raw materials were combined to form the finished laundry detergent in the following manner:

(1) The surfactant mixture was sprayed on a portion (64 wt. %) of the anhydrous soda ash in a ribbon blender, followed by addition of the miscellaneous ingredients.

(2) The solid mixture resulting from (1) and the balance of the solid soda ash were metered to a Shugi Flexomix Model 160 agglomerator along with the sodium silicate and water as liquid feeds, with changes in silicate and water contents compensated for by changes in soda ash content. The agglomerator runs were seven minutes at 2012 rpm and 40° C. product temperature to provide a dry, free flowing, −10 to +60 mesh product wherein the soda ash contained 17.0 weight percent water of hydration.

(3) The agglomerated product from (2) was transferred to a fluid bed dryer ($lm^2$, 3 zones operating at fluidization velocities of 418, 335.2 and 254.7 ft./min., respectively) and fluidized therein in ambient air (residence time about 24 minutes) to provide a dry, free flowing product wherein the soda ash contained 10.8 weight percent water of hydration.

Table I reports the effect on product properties of variations in the amount of water added during the agglomeration, pre-mixing of surfactant versus separate feeding of the nonionic and anionic surfactants, loading of surfactant onto soda ash prior to the agglomeration/hydration versus adding surfactant during the agglomeration/hydration, and adding concentrated silicate and water as separate feeds to the agglomerator versus adding diluted silicate only.

In Runs 1–6, 9 and 10, the soda ash was Grade 100, FMC Corporation, a natural soda ash refined by the sesquicarbonate process and typically having a bulk density of 47.8 $lb/ft^3$ (0.77 g/cc), a flow (angle of repose, degrees) of 19, and an absorptivity (surfactant absorbed/soda ash, weight percent) of 20. In Runs 7 and 8, the soda ash was Grade 160, FMC Corporation, also a natural soda ash refined by the sesquicarbonate process and typically having a bulk density of 59 $lb/ft^3$ (0.95 g/cc), a flow of 19°, and an absorptivity of 13. In Runs 5 and 7, the surfactant was added to the agglomerator simultaneously with silicate and water, and thus are representative of the process of U.S. Pat. No. 4,427,417 - Porasik. The remaining runs are representative of the present invention.

The test procedures (summarized below) to determine angle of repose and compression caking are standard procedures as described in "Detergent Applications Bulletin No. 10", FMC Corporation, Industrial Chemical Group, Philadelphia, Pa. These properties are also an indication of absorptivity because a material with low absorptivity tends to flow poorly and to cake.

Properties measured (1) Angle of respose: The angle to the horizontal of a pile formed by solid particles falling on a flat surface, indicating the flow characteristics of the solid. The greater the angle of repose, the poorer the flow properties.

(2) Compression caking: The weight required to break a cake, formed by two compressions in this test, is an indication of the caking tendency of a product. The higher the weight the greater the caking tendency.

Observations

The test results summarized in Table I demonstrate the following:

Runs 1–4: Increasing the amount of silicate while separately feeding silicate and water (Runs 1–3) decreases the bulk density, a favorable result. Run 4 shows that by not adding water with the silicate, in the form of a dilute silicate, caking tendency is increased, which is undesirable.

Runs 5 (prior art) and 6: Introducing mixed surfactant in the agglomerator (Run 5), rather than in the blender (Run 6), gave a product with an unacceptable high bulk density (Run 5). Spraying mixed surfactant (instead of nonionic, then anionic as in Run 2) in the blender significantly increased caking tendency (Run 6).

Runs 7 (prior art) and 8: Again, adding mixed surfactant in the agglomerator (Run 7) increased bulk density unacceptably, compared to adding mixed surfactant in the blender (Run 8). Compared to Runs 5 and 7, substitution of denser Grade 160 for Grade 100 soda ash gave a denser product only when surfactant was added in the blender (Runs 6 and 8); the Grade 160 products (Runs 7 and 8) had lower tendency to cake (compare with Runs 5 and 6).

Runs 9,10: Equivalent products were obtained when the silicate and water were premixed or added to the agglomerator separately. Spraying surfactant (nonionic then anionic) in the blender separately gave a product with lower caking tendency than when mixed surfactants were sprayed in the blender (Run 6).

EXAMPLE II

In another series of runs, the effect (on absorptivity of surfactant by soda ash) of the amount of water added with surfactant in the surfactant loading step (prior to agglomeration) was studied. As shown in Table II, the absorptivity decreased as the amount of water increased. Accordingly, for best absorptivity, the surfactant should be added to the soda ash before substantial hydration of the soda ash.

TABLE I

Effect of Processing Variables on Properties of Nonphosphate Laundry Detergents

| Run | Variation[1] | Detergent Property: Bulk Density (g/cc) | Angle of Repose° | Compression Caking (g)[4] |
|---|---|---|---|---|
| 1 | 5% N Silicate, 11% $H_2O$ | 0.66 | 21 | 200 |
| 2 | 15% N Silicate, 11% $H_2O$ | 0.60 | 23 | 0 |
| 3 | 20% N Silicate, 11% $H_2O$ | 0.58 | 23 | 0 |
| 4 | 15% N Silicate, 0% $H_2O$ | 0.60 | 18 | 200 |
| (5) | Mixed Surfactant/Agglomerator[2] | 0.67 | 18 | 430 |
| 6 | Mixed Surfactant/Blender[2] | 0.57 | 24 | 700 |
| (7) | Mixed Surfactant/Agglomerator (Grade 160) | 0.66 | 22 | 80 |
| 8 | Mixed Surfactant/Blender (Grade 160) | 0.62 | 25 | 55 |
| 9 | Individual Surf./Blender | 0.59 | 23 | 60 |
| 10 | Individual Surf./Blender Water Sep[3] | 0.58 | 23 | 50 |

[1]Variations (Runs 1, 3–10) from the basic recipe of Example 1 (Run 2). Runs 5 and 7 are comparative prior art processes.
[2]Location where liquid is introduced into the process.
[3]In Runs 1–4 and 10, silicate and water were introduced into the agglomerator as separate sprays. In the other runs, diluted silicate was sprayed into the agglomerator.
[4]The higher the number, the greater the caking tendency.

TABLE II

Effect of Hydration on Absorptivity

| Water (Wt. %) in Soda Ash/Water Mixture | Absorptivity (Wt. %)[1] (Surfactant Absorbed/Soda Ash) |
|---|---|
| 0 | 21.4 |
| 3.9 | 17.9 |
| 6.4 | 16.7 |
| 12.9 | 12.4 |
| 20.7 | 7.9 |

[1]The maximum % surfactant in a mixture of carrier and surfactant before onset of poor processing (poor flow, caking, etc.).

I claim:

1. A process for preparing a low bulk density, soda ashbased, nonphosphate agglomerated laundry detergent having increased resistance to liquid nonionic surfactant bleeding, which comprises (a) loading nonaqueous liquid surfactant onto substantially anhydrous, hydratable soda ash particles in the absence of added water, (b) turbulently dispersing the surfactant-loaded particles into an inert gaseous medium while wetting the dispersed particles with an atomized stream of dilute aqueous sodium silicate or with separate atomized streams of water and concentrated aqueous sodium silicate, to form the agglomerated detergent, the amount of sodium silicate added during the agglomeration constituting from about 15% to about 20% by weight of 38% concentrated aqueous sodium silicate (N-silicate) based on the total weight of the said detergent and (c) recovering the resultant agglomerated detergent.

2. The process of claim 1 wherein the hydratable soda ash is a natural source material.

3. The process of claim 2 wherein the natural source soda ash is refined by the sesquicarbonate process.

4. The process of claim 1 wherein, in step (a), a nonionic surfactant and an anionic surfactant are sequentially loaded onto the soda ash particles in the order of nonionic surfactant followed by anionic surfactant.

5. The process of claim 4 wherein the nonionic surfactant is an alcohol ($C_{12}$–$C_{15}$) ethoxylate and the anionic surfactant is a sulfated alcohol ($C_{12}$–$C_{15}$) ethoxylate.

6. The process of claim 1 wherein, prior to recovery in step (c), the particulate detergent resulting from the turbulent dispersion of step (b) is conditioned by passage through a fluid bed dryer.

7. The process of claim 1 wherein at least one dry, nonphosphate detergent adjuvant is introduced into the turbulent dispersion of step (b).

8. The process of claim 1 wherein at least one dry, nonphosphate detergent adjuvant is blended with the surfactant-loaded soda ash particles of step (a) prior to turbulent dispersion in step (b).

9. The process of claim 7 wherein the nonphosphate detergent adjuvant is at least one of sodium sulfate, sodium chloride, sodium carboxymethylcellulose, optical brightener, pigment and perfume.

10. The process of claim 8 wherein the nonphosphate detergent adjuvant is at least one of sodium sulfate, sodium chloride, sodium carboxymethylcellulose, optical brightener, pigment and perfume.

11. The nonphosphate agglomerated laundry detergent prepared by the process of claim 1.

12. The nonphosphate laundry detergent prepared by the process of claim 2.

13. The nonphosphate laundry detergent prepared by the process of claim 3.

14. The nonphosphate laundry detergent prepared by the process of claim 4.

15. The nonphosphate laundry detergent prepared by the process of claim 5.

16. The nonphosphate laundry detergent prepared by the process of claim 6.

* * * * *